US009691536B2

(12) United States Patent
Miyamoto et al.

(10) Patent No.: US 9,691,536 B2
(45) Date of Patent: Jun. 27, 2017

(54) STATIC APPARATUS

(71) Applicant: Hitachi, Ltd., Chiyoda-ku, Tokyo (JP)

(72) Inventors: Naoya Miyamoto, Tokyo (JP); Akira Yamagishi, Tokyo (JP); Hiroshi Miyao, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 158 days.

(21) Appl. No.: 14/596,476

(22) Filed: Jan. 14, 2015

(65) Prior Publication Data

US 2015/0213940 A1 Jul. 30, 2015

(30) Foreign Application Priority Data

Jan. 27, 2014 (JP) ..... 2014-012085

(51) Int. Cl.

| | |
|---|---|
| ***H01F 27/02*** | (2006.01) |
| ***H01F 27/08*** | (2006.01) |
| ***H01F 27/10*** | (2006.01) |
| ***H01F 27/12*** | (2006.01) |
| ***H01F 27/32*** | (2006.01) |

(52) U.S. Cl.

CPC ..... *H01F 27/12* (2013.01); *H01F 27/322* (2013.01); *H01F 27/324* (2013.01)

(58) Field of Classification Search

CPC ..... H01F 27/22; H01F 27/12; H01F 38/12; H01F 27/022

USPC ..... 336/55, 57, 58, 61, 90, 92, 94

See application file for complete search history.

(56) References Cited

U.S. PATENT DOCUMENTS 3,028,566 A * 4/1962 Camilli ..... H01F 27/18 174/15.1

FOREIGN PATENT DOCUMENTS

| | | | |
|---|---|---|---|
| JP | 43-21853 | | 9/1968 |
| JP | 52096313 A | * | 8/1977 |
| JP | 56-61028 | | 5/1981 |
| JP | 59-31212 U | | 2/1984 |
| JP | 62-193716 U | | 12/1987 |
| JP | 2000-260638 A | | 9/2000 |
| JP | 2013-65762 A | | 4/2013 |
| JP | 2013-69717 A | | 4/2013 |

OTHER PUBLICATIONS

English translation of Japanese-language Office Action issued in counterpart Japanese Application No. 2014-012085 dated Apr. 18, 2017 (3 pages).

* cited by examiner

*Primary Examiner* — Tsz Chan

(74) *Attorney, Agent, or Firm* — Crowell & Moring LLP

(57) ABSTRACT

A static apparatus is provided in which a partial discharge, if occurred in a winding end portion, is unlikely to lead to insulation breakdown. The windings and core of a static apparatus are housed in a tank filled with coolant. The winding is fixed by upper and lower parts supporting winding. A continuous coolant duct is formed in a section embracing the winding and the upper and lower parts supporting winding. A coolant duct from the wiring, extending through the upper or lower parts supporting winding and connected with the coolant space is configured in a structure in which toroidal ducts in multiple tiers are connected in a vertical direction of the winding. Connecting holes of one toroidal duct and of its next toroidal duct are staggered with respect to each other and spaced at intervals which are longer than the width of the toroidal ducts.

18 Claims, 5 Drawing Sheets

STATIC APPARATUS

BACKGROUND

The present invention relates to a static apparatus such as a transformer and a reactor and particularly to a static apparatus that cools the internal space of a winding assembly with coolant.

For a static apparatus such as a transformer and a reactor, the density of its heat generation caused by loss tends to increase, along with technical development for making its capacity greater and its size smaller. To cool such heat, a method of filling the tank of the static apparatus with a coolant is widely used.

For example, in the case of a transformer, a transformer assembly is housed in a tank and the tank is filled with a dielectric liquid coolant such as mineral oil, silicone liquid, vegetable oil, or synthetic ester oil so that the transformer assembly is immersed in the liquid. The transformer assembly is cooled by using cooling equipment such as a radiator and ribs or by circulating the liquid coolant through ducts formed between the tank wall surfaces and the transformer assembly. In the transformer assembly, a winding is the source of heat generation. A structure of ducts that are formed using insulation solids to allow the liquid coolant to flow from a section under the winding into a region surrounding the winding, while cooling the winding, flow out to a section above the winding is widely used. An internal coolant duct surrounding the winding is connected to coolant ducts provided in the sections of upper and lower parts that support and fix the winding from top and bottom.

For proper operation as the transformer, insulation must be ensured between each winding of a primary winding and a secondary winding or more windings, between electric conductors in the windings, between the windings and their cores, between the transformer tank and the windings, and the upper and lower end portions of the windings and their peripheral structures. The transformer is designed and manufactured to ensure dielectric strength in required specifications. In this process, it is most reasonable to develop a design to prevent a partial discharge from occurring and not to exceed upper-limit applied voltages in the required specifications. However, it is difficult to completely eliminate a possibility that a severe situation occurs with a high voltage temporarily in excess of the specifications, such as generation of a voltage higher than withstanding voltages required in specifications because of lightning strike or the like during use.

Therefore, taking such a severe situation into consideration, it is more preferable that the transformer has a structure in which a partial discharge, if occurs, is unlikely to lead to insulation breakdown. Generally, if a partial discharge has occurred in the lower end or upper end portion of the winding, the discharge progresses toward peripheral structures like parts fastening core, when the discharge progresses through the coolant ducts in the sections of the upper and lower parts supporting the winding and, in most cases, progresses through the coolant and along the surfaces of the insulation solids forming the coolant ducts. When the progressed discharge reaches the peripheral structures like the parts fastening core, it results in insulation breakdown. To cause insulation breakdown, the longer the streamer length, the larger energy causing the discharge is needed.

For example, in Japanese Unexamined Patent Application Publication No. 2013-65762, a method is disclosed that divides the space of a coolant duct into small partitions by insulation solids, thus reducing the probability of existence of a weak point in terms of insulation within one space.

SUMMARY

The insulation structure of a static apparatus is reasonably designed to fulfill the required specifications and, at the same time, it is preferable that the apparatus has a structure in which a partial discharge, if occurs under conditions of severe voltage application in excess of the specifications, is unlikely to lead to insulation breakdown.

The invention described in Japanese Unexamined Patent Application Publication No. 2013-65762 has an advantageous effect of reducing a risk of discharge generation caused by dust or the like in the coolant by partitioning a duct by insulation solids. But, in a case where a discharge progresses, generated in a winding end portion or a shield provided in the end portion, an effect that can avoid insulation breakdown is limited.

The present invention is intended to provide a static apparatus in which a partial discharge, if has occurred in a winding end portion, is unlikely to lead to insulation breakdown, progressing from the winding end portion to peripheral parts, by lengthening a creeping distance extension with insulation solids from the winding end portion of the static apparatus up to the peripheral parts such as the parts fastening core.

To solve the above problem, one aspect of the present invention resides in a static apparatus including a tank, coolant being sealed in the tank, and a core of the static apparatus being housed in the coolant. The core of the static apparatus has at least two core legs and windings which are wound around each of the core legs. The core of the static apparatus is fastened and fixed by core fastening pats at the upper and lower ends. The winding supporting members, which are of insulating material, are provided respectively between the windings and the core fastening parts. The windings and the windings supporting members have coolant ducts. At least one of coolant ducts provided in the windings supporting members is toroidal ducts formed in multiple tiers in a vertical direction. The toroidal ducts are connected to each other by connecting holes in one or more places. Each of the connecting holes is arranged at intervals which are longer than the width of the toroidal ducts.

According to the present invention, in a case where a voltage higher than withstanding voltages required in specifications has been applied to the static apparatus, it can be prevented that a partial discharge, if occurs, leads to insulation breakdown and reliability is enhanced.

DETAILED DESCRIPTION

In the following, a preferred embodiment for carrying out the present invention will be described with the aid of the drawings. The following description only concerns an exemplary embodiment and is not intended to limit the embodiment of the present invention.

First Embodiment

Figure 1:
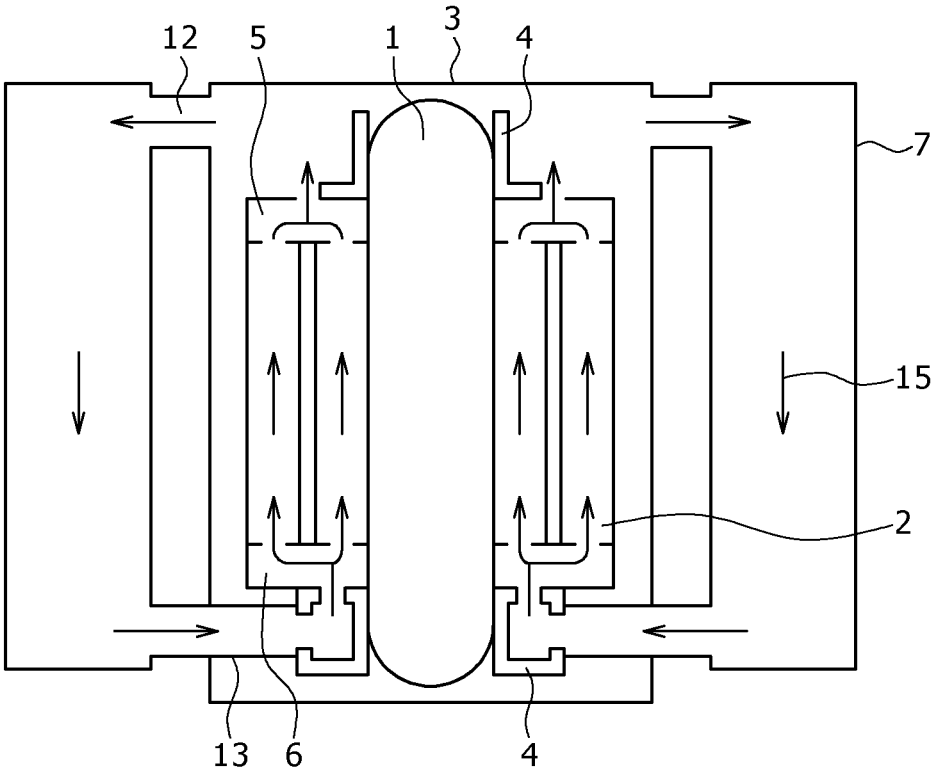
FIG. 1 depicts the cross-section structure of a transformer to which the present invention is applied.

FIG. 1 depicts an overall coolant duct structure of a static apparatus to which the present invention is applied. Windings and core of a static apparatus including a core leg 1 and a winding 2 wound around the core leg 1 are housed in a tank 3. A coolant is sealed within the tank 3 and the windings and core of a static apparatus are immersed in the coolant.

The structure of the windings and core of a static apparatus is cross-sectionally depicted in FIG. 1 to clarify the placement of one core leg 1, the winding 2 wound around the core leg, parts fastening core 4, and upper part supporting winding 5 and lower parts supporting winding 6 located at the top and bottom of the winding. However, the assembly actually has two or more core legs and can have a structure such as, e.g., a single-phase two-leg core, a single-phase three-leg core, a three-phase three-leg core, or a three-phase five-leg core.

The upper and lower end portions of the core are fastened and fixed by the parts fastening core 4. The upper parts supporting winding 5 are installed in contact with the upper end portion of the winding 2 and the lower parts supporting winding 6 are installed in contact with the lower end portion of the winding 2. The winding 2 is fixed from top and bottom by the upper parts supporting winding 5 and the lower parts supporting winding 6.

A continuous coolant duct is formed through a section embracing the lower parts supporting winding 6, the winding 2, and the upper parts supporting winding 5. At the upper parts supporting winding 5 and the lower parts supporting winding 6, the coolant duct is connected with a coolant space (a region which surrounds the windings and core of a static apparatus and the upper and lower parts supporting winding 5, 6 inside the tank).

Coolers 7 that cool the coolant are installed outside the tank 3 and the upper and lower end portions of the tank 3 and the coolers 7 are connected by connecting ducts 12. The connectors of the connecting ducts 12 in the lower end portion of the tank 3 are connected to the lower parts supporting winding 6 through ducts in lower of tank 13. A part fastening core 4 in the lower end portion is tubular and has a structure that also serves to define a part of the ducts in lower of tank 13. But, the ducts in lower of tank 13 may be formed independently of the part fastening core 4 in the lower end portion.

The coolant may be flowed by a source of power like a pump installed in the duct or may be flowed by thermal convection If there is not a source of power like a pump in the coolant duct, the ducts in lower of tank 13 may be dispensed with. If the windings and core of a static apparatus are foreseen to be cooled enough without the coolers 7, further, the coolers 7 may be dispensed with.

Figure 2:
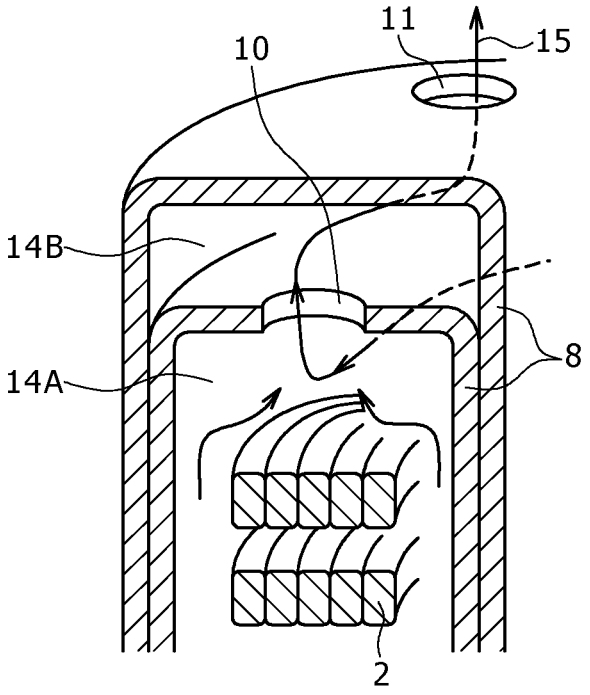
FIG. 2 depicts a coolant duct structure within the section of upper parts supporting winding and is an enlarged cross-sectional view of a key part of the transformer to which the present invention is applied.

The present invention is particularly applied to the coolant duct structure in the sections of the upper parts supporting winding 5 and the lower parts supporting winding 6 depicted in FIG. 1. In the section of the upper parts supporting winding 5, as depicted in FIG. 2, a first toroidal duct 14A is formed by providing a space between the top end portion of the winding 2 and a U-shaped insulation solid 8 placed over the top end of the wiring and a second toroidal duct 14B is formed by forming another U-shaped insulation solid 8 further over the U-shaped insulation solid 8.

The first toroidal duct 14A is connected with the second toroidal duct 14B via holes of a ducts connector A 10 and the second toroidal duct 14B is connected with the coolant space inside the tank via holes of a ducts connector B 11.

The holes of the ducts connector A 10 for connection between the first toroidal duct 14A and the second toroidal duct 14B are provided, for example, in eight places at intervals of a 45-degree center angle in a common wall of the insulation solid 8 separating the first toroidal duct 14A and the second toroidal duct 14B. Similarly, the holes of the ducts connector B 11 are provided in eight places at intervals of a 45-degree center angle in the insulation solid 8 that defines an upper wall of the second toroidal duct 14B.

It is preferable that the holes of the ducts connector A and the holes of the ducts connector B are staggered with respect to each other in the circumferential direction of the winding at a staggered angle of 22.5 degrees. As for the holes of each ducts connector, the number of the holes, arrangement of the holes in the circumferential direction, and the shape of the holes are not limited to those depicted in FIG. 2. These holes may be arranged to be spaced at an interval such that the distance between each hole of the ducts connector A and each hole of the ducts connector B is longer than the width of the toroidal ducts 14.

The walls having the holes of the ducts connector A 10 and the holes of the ducts connector B 11 are not limited to the upper wall and the lower wall of the toroidal ducts 14. These holes may be provided in the inner and outer circumferential sidewalls of the ducts, if they fulfill the function of connecting the ducts.

Third and fourth toroidal ducts may further be connected in the same way in which the second toroidal duct 14B is connected to the first toroidal duct 14A. In that case, a highest-tier toroidal duct is connected with the coolant space via holes in a wall other than a lower duct wall. According to such a structure, an entire coolant duct is realized through which the coolant flows in a zigzag manner in the circumferential direction from the innermost duct directly surrounding the winding toward the coolant space inside the tank.

Figure 3:
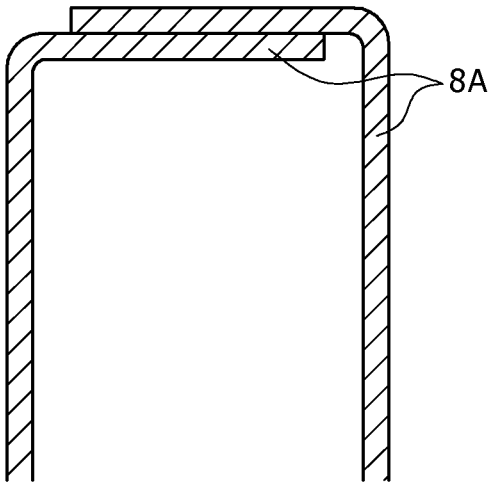
FIG. 3 depicts an example of practically forming a U-shaped insulation solid in FIG. 2.
Figure 4:
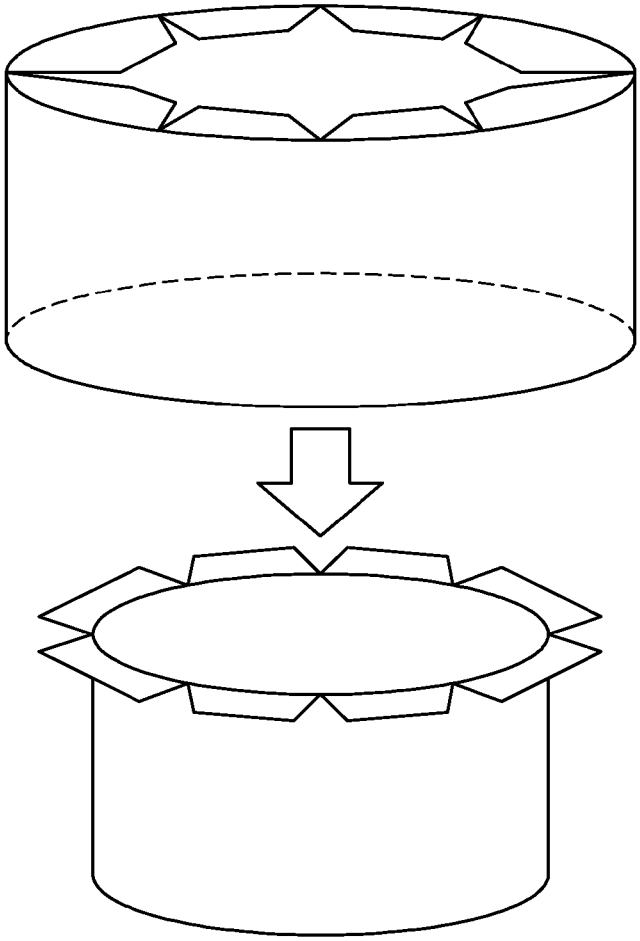
FIG. 4 depicts an example of practically forming a U-shaped insulation solid in FIG. 2.
Figure 5:
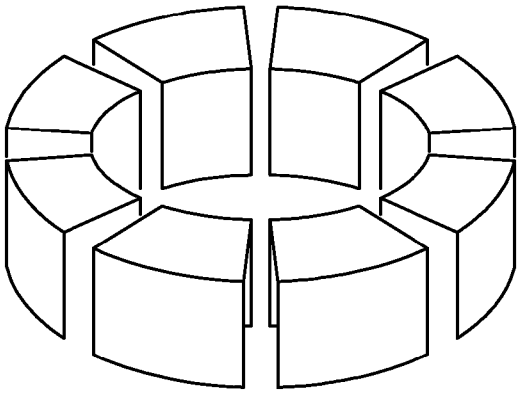
FIG. 5 depicts another example of forming an insulation solid for use in the present invention.

Each U-shaped insulation solid 8 may be realized by joining L-shaped insulation solids 8A together, as depicted in FIG. 3. In this case, two cylindrical insulation solids with notched brims, as depicted in FIG. 4, may be joined together, after folding inward the notched brim of one cylindrical solid and folding outward the noticed brim of the other cylindrical solid so that they have an L-shaped cross section.

Although the holes of the ducts connector A 10 and the holes of the ducts connector B 11 are provided by opening holes in the duct walls, an insulation solid forming a duct wall may be cut into segments and the segments may be arranged to provide gaps at intervals in the circumferential direction.

Figure 6:
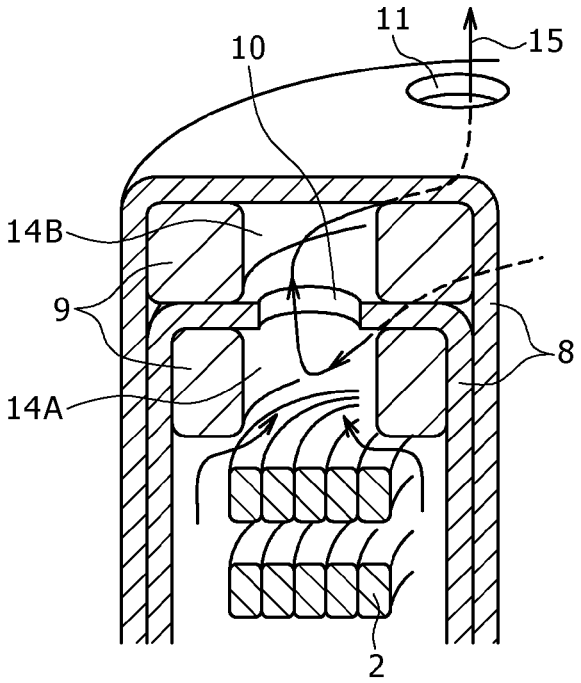
FIG. 6 depicts an example of a structure in which parts supporting ducts are installed in toroidal ducts in FIG. 2.

In the structure of the toroidal ducts 14 depicted in FIG. 2, the ducts can be supported in a way such as joining the U-shaped insulation solids 8 together. However, as depicted in FIG. 6, inside the toroidal ducts 14, parts supporting ducts 9 which are toroidal insulation solids having a rectangular cross-section may be provided to support the ducts.

Figure 7:
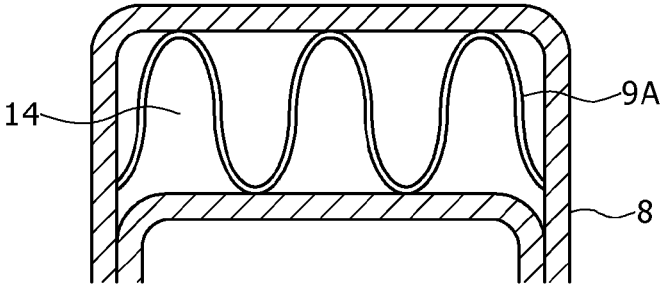
FIG. 7 depicts an example of parts supporting ducts for use in the present invention.
Figure 8:
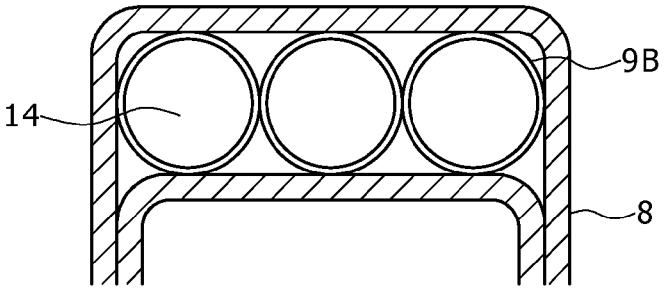
FIG. 8 depicts another example of parts supporting ducts for use in the present invention.
Figure 9:
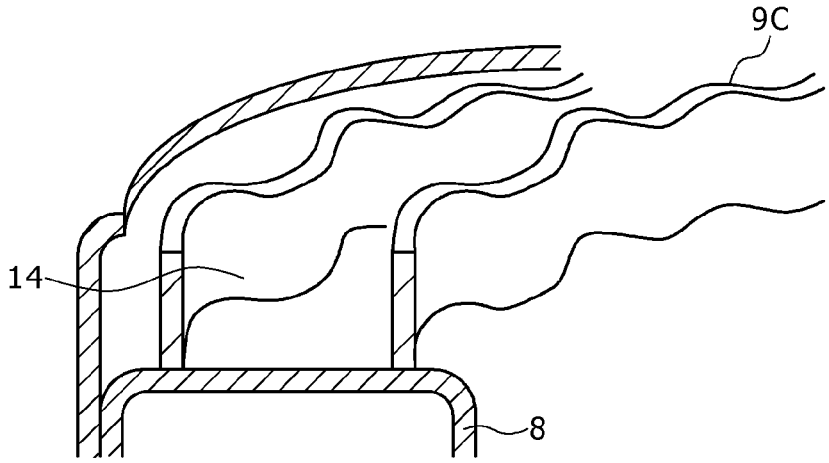
FIG. 9 depicts yet another example of parts supporting ducts for use in the present invention.
Figure 10:
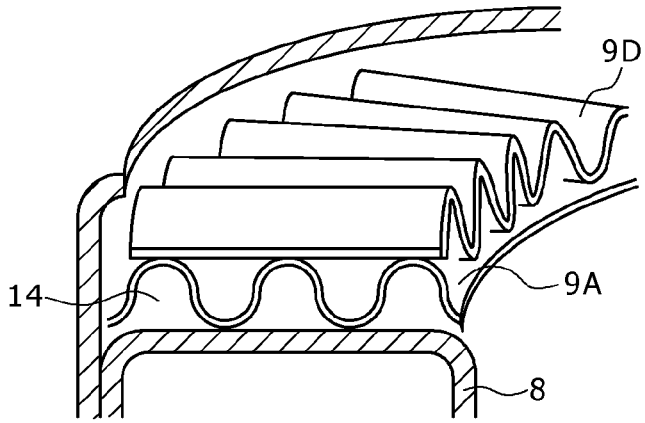
FIG. 10 depicts yet another example of parts supporting ducts for use in the present invention.

The shape of the parts supporting ducts 9 is not limited to the above rectangular cross section shape, if such parts can support the ducts. For example, the following parts may be used: a part having a corrugated cross section in an axial direction of the winding, which is depicted in FIG. 7; a part having a circular cross section in the axial direction of the winding, which is depicted in FIG. 8; a part having a corrugated cross section in an radial direction of the winding, which is depicted in FIG. 9; and a part having a corrugated cross section in a circumferential direction of the winding, which is depicted in FIG. 10, combined with the one depicted in FIG. 7.

These parts supporting ducts are not required to be continuous in the circumferential direction of the winding and they may be split into several pieces and these pieces may be arranged at intervals in the circumferential direction of the winding.

Figure 11:
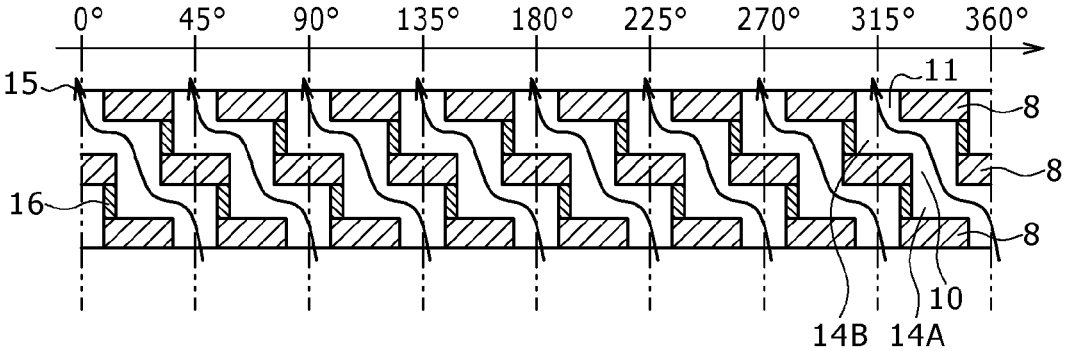
FIG. 11 is a diagram of a planar representation of the cross section of toroidal ducts in a circumferential direction and depicts an example of arrangement of partitions provided in positions in the circumferential direction.

At least the second toroidal duct and subsequent toroidal ducts 14 are not required to be continuous over the whole circumference and may be partitioned at several places. For example, the ducts may be configured as depicted in FIG. 11. FIG. 11 is a planar representation of annular toroidal ducts 14 for the safe of explanatory convenience. In this way, the toroidal ducts 14 may be configured as the ducts partitioned at intervals of a 45-degree center angle on the U-shaped insulation solid 8. In this case, it is only required that the distance between each hole of the ducts connector A and each hole of the ducts connector B is larger than the width of the toroidal ducts. For any of the first and subsequent toroidal ducts 14, its cross-sectional shape in the axial direction is not required to constant.

While the structures of the ducts in the section of the upper parts supporting winding 5 have been presented by a combination of insulating material members of general shapes so that they can be realized easily, a plurality of members may be formed by a monolithic block of an insulating material. The structure of a section that is not related to the duct structures is not restrictive.

While the structures depicted in FIGS. 2 through 11 relate to the section of the upper parts supporting winding 5, the same structures are also applicable for the section of the lower parts supporting winding 6, though they flip vertically. Structures that are selected in the upper end and lower end sections around the winding 2 may differ or a combination of the above structures and conventional structures applied in one of these sections may be possible.

The upper parts supporting winding 5 connect the internal ducts surrounding the winding and the coolant space inside the tank 3, as described with FIG. 1, whereas the lower parts supporting winding 6 connect the internal ducts surrounding the winding and the ducts in lower of tank 13 or the coolant space inside the tank 3.

In the present embodiment, it is possible to effectively extend the lengths of the coolant ducts that are formed within the sections of the upper parts supporting winding 5 and the lower parts supporting winding 6. Consequently, in a case where a partial discharge has occurred in the upper end or lower end portion of the winding, the streamer length required to reach peripheral structures becomes longer. The reliability of insulation of the static apparatus can be enhanced more than ever before.

What is claimed is:

1. A static apparatus comprising:

a tank;

coolant being sealed in the tank;

a core of the static apparatus, housed in the coolant, having at least two core legs and windings, the windings being wound around each of the core legs, the core of the static apparatus being fastened and fixed by core fastening parts at the upper and lower ends; and windings supporting members, which are of insulating material, being provided respectively between the windings and the core fastening parts, wherein the windings and the windings supporting members have coolant ducts, at least one of coolant ducts provided in the windings supporting members being toroidal duct formed in multiple tiers in a vertical direction, the toroidal ducts being connected to each other by connecting holes in one or more places, each of the connecting holes being arranged at intervals which are longer than the width of the toroidal ducts.

2. The static apparatus according to claim 1, wherein one of the toroidal ducts is formed between the end portion of the winding and a U-shaped insulation element which is placed over the winding, and wherein another toroidal duct is further formed between the U-shaped insulation element and another U-shaped insulation element which is placed over the U-shaped insulation element.

3. The static apparatus according to claim 2, wherein the U-shaped insulation element is formed with two L-shaped insulation elements.

4. The static apparatus according to claim 1, further comprising duct supporting members between duct walls of the toroidal ducts.

5. The static apparatus according to claim 2, further comprising duct supporting members between duct walls of the toroidal ducts.

6. The static apparatus according to claim 3, further comprising duct supporting members between duct walls of the toroidal ducts.

7. The static apparatus according to claim 4, wherein the duct supporting members have a corrugated cross section in the axial direction of the winding.

8. The static apparatus according to claim 5, wherein the duct supporting members have a corrugated cross section in the axial direction of the winding.

9. The static apparatus according to claim 6, wherein the duct supporting members have a corrugated cross section in the axial direction of the winding.

10. The static apparatus according to claim 4, wherein the duct supporting members have a circular cross section in the axial direction of the winding.

11. The static apparatus according to claim 5, wherein the duct supporting members have a circular cross section in the axial direction of the winding.

12. The static apparatus according to claim 6, wherein the duct supporting members have a circular cross section in the axial direction of the winding.

13. The static apparatus according to claim 4, wherein the duct supporting members have a corrugated cross section in the radial direction of the winding.

14. The static apparatus according to claim 5, wherein the duct supporting members have a corrugated cross section in the radial direction of the winding.

15. The static apparatus according to claim 6, wherein the duct supporting members have a corrugated cross section in the radial direction of the winding.

16. The static apparatus according to claim 4, wherein the duct supporting members are a combination of an element having a corrugated cross section in the axial direction of the winding and an element having a corrugated cross section in a circumferential direction of the winding.

17. The static apparatus according to claim 5, wherein the duct supporting members are a combination of an element having a corrugated cross section in the axial direction of the winding and an element having a corrugated cross section in a circumferential direction of the winding.

18. The static apparatus according to claim 6, wherein the duct supporting members are a combination of an element having a corrugated cross section in the axial direction of the winding and an element having a corrugated cross section in a circumferential direction of the winding.

* * * * *